US005556511A

United States Patent [19]

Bluhm et al.

[11] Patent Number: 5,556,511

[45] Date of Patent: Sep. 17, 1996

[54] PROCESS FOR DRYING PAPER WEBS

[75] Inventors: Reinhard Bluhm, Berg; Thomas Gotz, Hagnau, both of Germany

[73] Assignee: Sulzer-Escher Wyss GmbH, Ravensburg, Germany

[21] Appl. No.: 313,136

[22] Filed: Dec. 15, 1994

[30] Foreign Application Priority Data

May 16, 1992 [DE] Germany ..... 42 16 264.5

[51] Int. Cl.[6] ..... D21F 11/02

[52] U.S. Cl. ..... 162/206; 162/205; 162/111

[58] Field of Search ..... 162/111, 205, 162/206, 207, 358.1, 358.3, 358.5, 359.1, 360.2, 360.3, 192, 305, 290, 101; 428/153, 152

[56] References Cited

U.S. PATENT DOCUMENTS

| | | | |
|---|---|---|---|
| 2,696,148 | 12/1954 | Hornboutel | 162/358.1 |
| 3,149,025 | 9/1964 | Dickens | 162/206 |
| 3,821,068 | 6/1974 | Shaw | 162/111 |
| 3,880,705 | 4/1975 | Tilburg | 162/101 |
| 4,526,655 | 7/1985 | Karvinen et al. | 162/360.1 |
| 4,576,682 | 3/1986 | Laapotti | 162/358.1 |
| 4,738,752 | 4/1988 | Busker et al. | 162/358.5 |
| 4,788,779 | 12/1988 | Sparkes | 34/117 |
| 4,874,469 | 10/1989 | Pulkowski et al. | 162/358.5 |
| 4,879,001 | 12/1989 | Cronin | 162/206 |
| 4,948,466 | 8/1990 | Jaakkola | 162/207 |
| 4,976,820 | 12/1990 | Laapotti | 162/206 |
| 4,976,821 | 12/1990 | Laapotti | 162/360.1 |
| 5,048,589 | 9/1991 | Cook et al. | 162/109 |
| 5,071,513 | 12/1991 | Bluhm et al. | 162/206 |
| 5,092,962 | 3/1992 | Koski | 162/358.5 |
| 5,164,047 | 11/1992 | Koski | 162/206 |
| 5,269,885 | 12/1993 | Tavi | 162/358.1 |

FOREIGN PATENT DOCUMENTS

| | | |
|---|---|---|
| 0258169 | 3/1988 | European Pat. Off. . |
| 0296730 | 12/1988 | European Pat. Off. . |
| 0337973 | 10/1989 | European Pat. Off. . |
| 3705241 | 7/1988 | Germany . |
| 9113500 | 2/1992 | Germany . |
| 2199398 | 7/1988 | United Kingdom . |

OTHER PUBLICATIONS

International Search Report and Annex.

*Primary Examiner*—Donald E. Czaja
*Assistant Examiner*—Calvin Padgett
*Attorney, Agent, or Firm*—Greenblum & Bernstein P.L.C.

[57] ABSTRACT

Process and device for drying paper webs, with the process being utilized for drying voluminous paper webs, destined in particular for use as toilet paper, with at least one heated press being used for drying the wet paper web, with the undesirable delamination of the paper web, when it leaves the compression gap, caused by the sudden expansion of the flash steam, being purposefully used in order to improve the volume and softness of the thus produced paper. Several devices are also set forth for implementing the process, these devices having both short and elongate compression gaps.

18 Claims, 4 Drawing Sheets

PROCESS FOR DRYING PAPER WEBS

CROSS REFERENCE TO RELATED APPLICATIONS

This application claims the priority of PCT Application No. PCT/EP93/00890, filed Apr. 13, 1993, which in turn claims the priority of German Application No. DE P 42 16 264.5, filed May 16, 1992, the disclosures of which are incorporated herein by reference in their entireties.

BACKGROUND OF THE INVENTION

1. Field of the Invention

The present invention pertains to a process for drying a paper web, particularly for the production of toilet paper.

As is well known in the production of paper, initially a wet web is formed which subsequently must be drained and dried in order to render the paper usable. Therefore, processes can be used which require a relatively large steam heated drying cylinder. Such cylinders, whose production and assembly are quite expensive, are also known as Yankee-cylinders. They approach a diameter of over 5 meters and are activated with steam pressure in the cylinder up to 8 bar.

2. Discussion of the Background of the Invention and Material Information

With known creping processes, by means of a scraper, the dried paper web, adhered on a surface, can be buckled or upset on the hot press roll at its removal therefrom. Other possibilities are also known, for example for finish drying a web, with a dry weight of below 95%, on a separate creping cylinder and thereafter creping same.

Additional processes for formal drainage are known to those skilled in the art, for example, as taught in German patent publication DE 3705241. This process pertains to a very special technology, in which steam is produced in a press gap or compression gap, with the steam driving the water from the paper web which is then taken or absorbed by the felts running through the press and are removed therefrom as water, steam or condensate. In this manner, a portion of the moisture is effectively and quickly removed. Often such processes are utilized in the process having elongated gaps, that are known as shoe presses or wide-nip presses. After running through the hot press gap, the paper web becomes free and can filter out steam. It is, however, suddenly exposed to the very much lower ambient pressure, whereby the steam pressure of the overheated remaining water, depending on each type and area weight of the web, can lead to different destructions or injuries, for example, delaminations of the paper web via "flash steam". The possibilities of the process are therefore limited to specific types of paper. Through suitable measures, often requiring considerable technical control expenditures, safe operation can be achieved, during which the steam pressure, at the press gap, is limited to a value below ambient pressure at the cost of reduced drainage effect.

SUMMARY OF THE INVENTION

The task of the invention is to produce a process of the known type that achieves a high drying capacity and whereby also a high volume or high density paper quality is achieved.

The present invention solves the previously-noted problems via a process for drying a paper web for the production of toilet paper, having a final dry weight of at least 60%, the process comprising: guiding a moist paper web, together with at least one water-absorbing belt through at least one press zone between two press areas; transferring at least such an amount of heat into the paper web in one of before and in the at least one press zone so that the steam pressure being formed in the fiber structure is greater than the ambient pressure but less than the pressure existing in the press zone; and so adjusting the pressure and temperature conditions in the press zone that even at the end of the press zone the steam pressure occurring in the liquid is slightly greater than ambient pressure.

Further embodiments of the process of this invention include supplying additional heat to the paper web after the paper web leaves the press zone; forming the press areas as an elongated press zone; and utilizing two successively, when viewed in the direction of movement of the web, arranged press zones.

Another embodiment of the process of this invention includes, as a result of the heating of the paper web in the at least one press zone, lifting the paper web, due to steam generation, from a portion of the press area, not in contact with the felt, and depositing the paper web on the felt.

A further embodiment of the process of this invention includes, as a result of the heating of the paper web in a last one of the at least press zone, lifting the paper web, due to steam generation, from a portion of the press area, not in contact with the felt, and subsequently removing the paper web.

An additional embodiment of the process of this invention includes, one of coiling and treating the removed paper web without the paper web undergoing creping.

Variations of previous embodiments of this invention include, maintaining the surface temperature of a press area, in a last one of the at least one press zone, at at least 150° C. and maintaining the surface temperature of a press area, in the last press zone, at approximately 300° C.

Further embodiments of the process of this invention include, supplying the web to the first press zone with an initial dry weight of between 10 and 30% absolutely dry, and selecting the parameters that the web, after the drying in a last one of the at least one press zone, has a dry weight of more than 80% absolutely dry.

Additional variations of the process of this invention include maintaining the web temperature, ahead of the last press zone, between 50° and 100° C., preferably at at least 80° C.

Still further embodiments of the process of this invention include, maintaining the dwelling time of the web in each press zone for at least 15 milliseconds; maintaining the pressure existing in the press zone at at least 10 bar; and keeping the web being dried at a sheet weight of between 10 and 40 g/m$^2$, absolutely dry.

Yet further embodiments of the process of this invention include, introducing the heat addition above a press area, and/or introducing the heat addition ahead of a press zone.

This invention also includes an apparatus for carrying out the process for drying a paper web for the production of toilet papers, the apparatus including a press apparatus wherein at least one press zone is formed as a press gap between two press areas, of which at least one can be heated, wherein the press apparatus includes at least one press gap, formed between two press rolls, with the press gaps being formed by a movable one of the press rolls movable in the direction toward the paper web and a counter roll of the press rolls wherein both press rolls each have a hard, only slightly and elastically deformable cylindrical covering.

Another embodiment of the apparatus of this invention further includes a press apparatus, in which at least one press zone is formed as a press gap between the press areas, at least one of which can be heated, wherein the press apparatus further includes two successive press gaps.

In further embodiments of the apparatus of this invention one press area can be electrically-resistance heated or heated by a fluid medium carried via channels.

In an additional embodiment of the apparatus of this invention, the press shoe includes an induction heating element, with the heating element causing a heating up of the outer surface of the counter roll.

In differing embodiments of the apparatus of this invention the press apparatus includes a short as well as an elongated press gap or two press gaps with a common felt, or two press gaps with a common press roll, with each press gap having a different press felt.

In yet further variations of the apparatus of this invention, a heating apparatus is included in front of a press zone for heat transfer to the web, with the heating apparatus preferably being a steam blasting box, located in front of a press zone, with the felt that carries the web moving over the steam blasting box.

In still a differing embodiment of the apparatus of this invention, the heating apparatus is a heat radiator that radiates heat to the web that is to be dried.

In a final embodiment of the apparatus of this invention the press rolls have a maximum outer diameter of three meters.

By means of this process the noted types of paper can be dried on smaller constructional units than before, whereby the conditions, particularly at the exit of the web from the press gap, achieve a volume increase of the paper. These additional volumes are thus produced in that a part of the water, remaining in the web as a result of the impact-like pressure tension release, evaporates or vaporizes, and disaggregates the fiber matrix of the paper web before all the fiber bonds or links are accomplished via hydrogen bridge linkages. In addition, via the noted impact-like pressure tension release, the fibers at the surface can be raised up, whereby, with specific types of paper, a desired subjective softness, that is a "soft grip" can be achieved.

An additional advantage can be observed in that work can proceed in the press gap even at relatively high temperatures due to the relatively high pressure, which permits very quick heat transfer into the paper web.

For carrying out the process, press apparatuses with one or more press gaps, such as short or elongated press gaps are feasible. A short press gap is generally produced through the opposed pressings of rolls with hard and only slightly deformable coverings (hard nip). An elongated press gap (wide nip) can be produced in that the press force is supplied via a movable press shoe in the direction toward the paper web, with a press shoe having an endless impervious, deformable covering, whereby the form of the press shoe is so shaped that the deformable covering can adapt itself to the form of the counter roll.

The types of paper for which the use of this drying process is of particular advantage, are the so-called toilet papers. These toilet papers are produced in the sheet forming portion of the paper making machine in relatively light webs. The sheet weight of such types of paper is between 10 and 40 $g/m^2$, measured at the dry web. Values of between 40 and 60 $g/m^2$ are deemed extreme for toilet papers, whereby it must be considered that, via an eventual creping reaction procedure, an increase of the sheet weight, with reference to the sheet weight in the wet portion of the paper making machine, is achieved.

The process of this invention can also produce a toilet paper of good quality when the process is used without a crepe scraper. Crepe scrapers indeed increase the possibilities relative to the paper quality, but on the other hand are costly and can be the source of increased wear. Due to the special conditions that occur in the inventive process, the volume, grip and surface softness can be so good that the creping can be eliminated.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein there is shown in.

The invention and its advantages will be explained in view of different drawings that are briefly listed as follows.

DETAILED DESCRIPTION OF THE PREFERRED EMBODIMENTS

Figure 1:
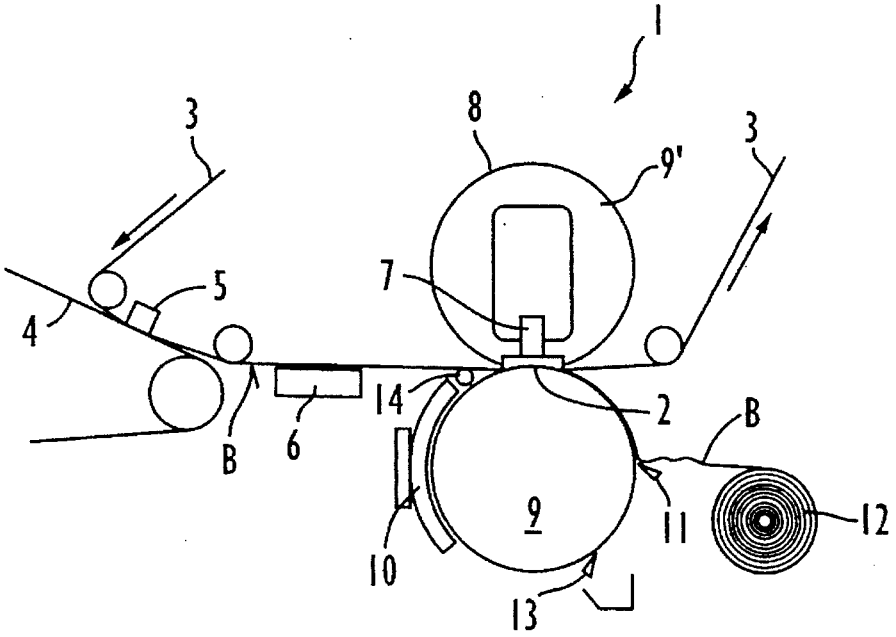
FIGS. 1 and 2 are schematic side views of the arrangements for carrying out the process, each with one wide nip press.

FIG. 1 schematically shows an operative arrangement for carrying out the process. The exaggerated thickly drawn paper web B is received in a wet sieve or screen 4 above a pick up suction apparatus 5 and conveyed to press apparatus 1 with a felt 3 or an equivalent structure. The press apparatus is, in this example, modeled as a wide nip press with two rolls 9 and 9', whereby a press shoe 7, movable in the press direction, presses its elastic covering 8 against a counter roll 9 in a manner that the elastic covering 8 adapts itself to the contours of counter roll 9. The heat required for carrying out the process can, as in this case, be achieved via the heating up of the counter roll by means of an external heating element 10. In addition, heating steam blasting boxes 6 or other such heating units are also feasible for directly heating the web and felt 3. The heated paper web, at the exit from press gap 2, stays on counter roll 9 and is subsequently creped over a scraper 11 and wound on a winding roll 12. In order to improve the adhesion of the web during creping, an adhesion means is applied via a spray pipe 14. The application can, as drawn here, be made with a thin layer, the so-called coat, onto the outer surface of roll 9, but also via spraying directly onto web B, in case the penetration therethrough is acceptable. Appropriately, a cleaning scraper 13 removes all material remnants from roll 9.

Figure 2:
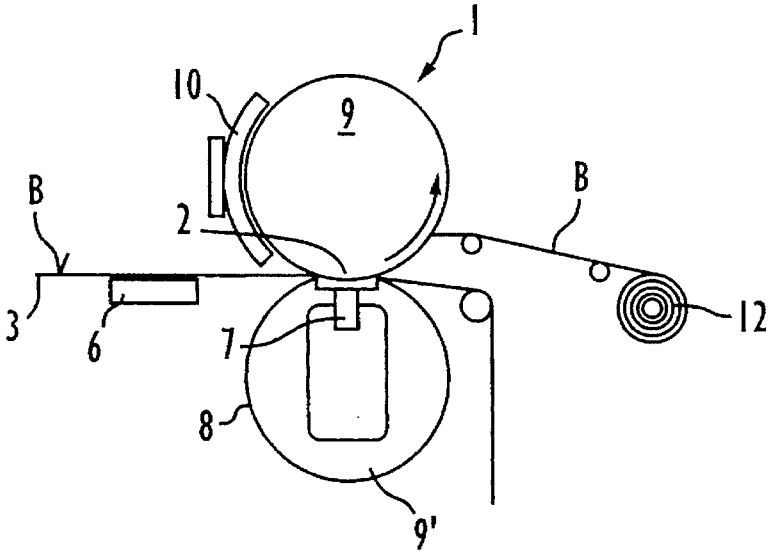
Figure 3:
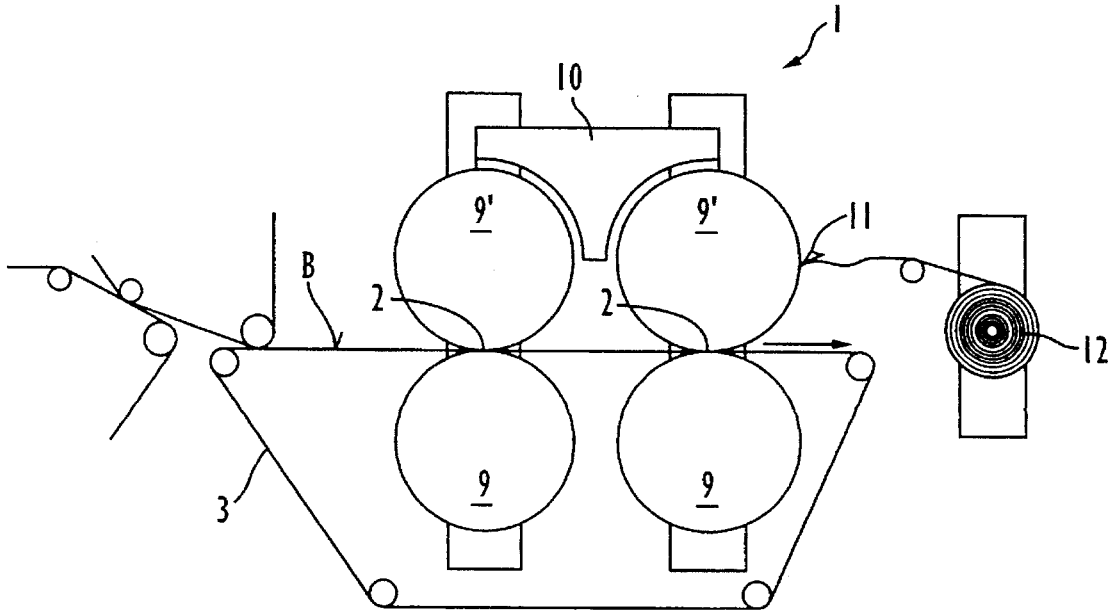
FIGS. 3 and 4 are schematic views of further arrangements for carrying out the process, each with two separated presses.
Figure 4:
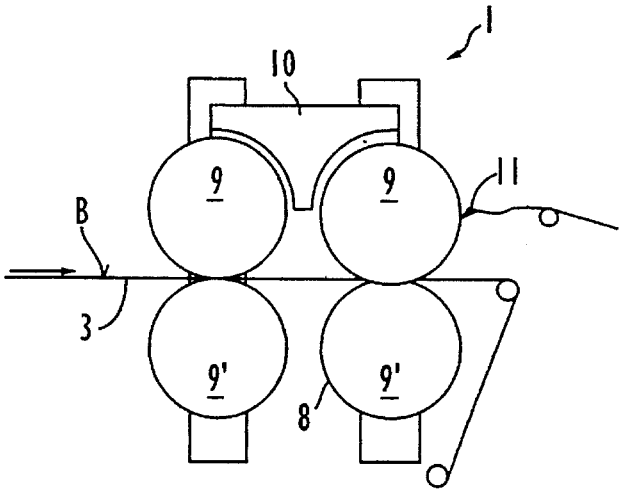

As shown in FIG. 2, the execution of the process is also possible when the counter roll is not arranged underneath but above the press shoe. In addition, the removal of the dry paper web is illustrated without a crepe scraper. This depends essentially on the type of paper and the process parameters. The press apparatus can, as for example shown in FIG. 3, also include two press gaps 2, each formed via press roll 9' and counter roll 9, with the gaps being successively passed through by paper web B together with felt 3. In the shown instance, no wide nip presses are utilized. A combination of wide nip and hard nip presses is also feasible whereby the sequence hard nip, then wide nip, is in general particularly favorable (FIG. 4) since the volume generation in the wide nip can usually be carried out more effectively. The heat, in these examples, is transferred from heating devices 10 to counter roll 9 and from there, in the press gap, to web B. Even two wide nip presses can be of advantage when exacting requirements are set forth.

Figure 5:
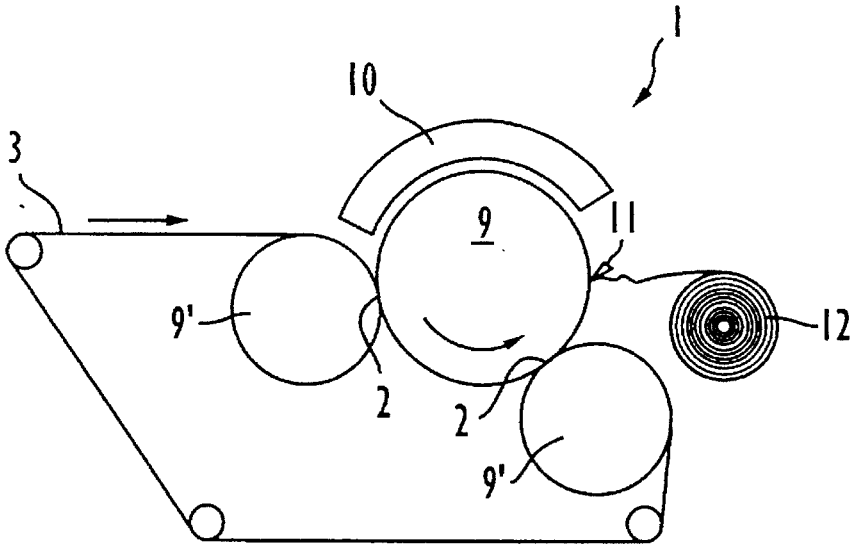
FIGS. 5 and 6 are schematic side views of arrangements for carrying out the invention, each with a combined double press.
Figure 6:
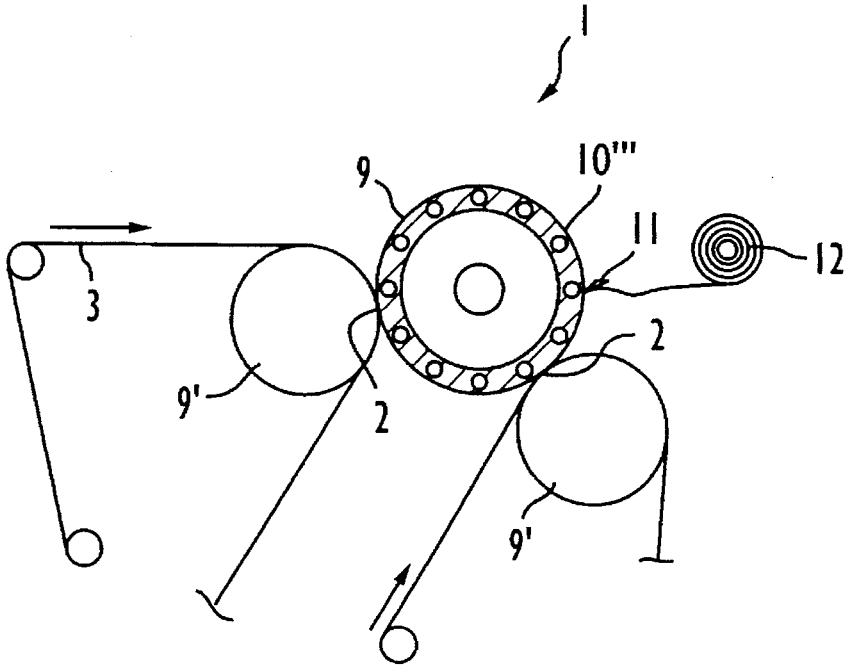

Additional possibilities can result as, for example, in FIGS. 5 and 6, which utilize two press gaps that are formed in that at a common roll, two respective subsequently arranged counter rolls 9' are pressed thereagainst. It is also feasible to utilize an arrangement with one felt 3 (FIG. 5) or two felts 3, 3' (FIG. 6) or drying sieves. The FIG. 5 example schematically shows that the heating can occur by means of electric heating rods or also pipes 10''' for a heating medium that are built into the interior of the counter roll. This also applies to the other constructions.

Figure 7:
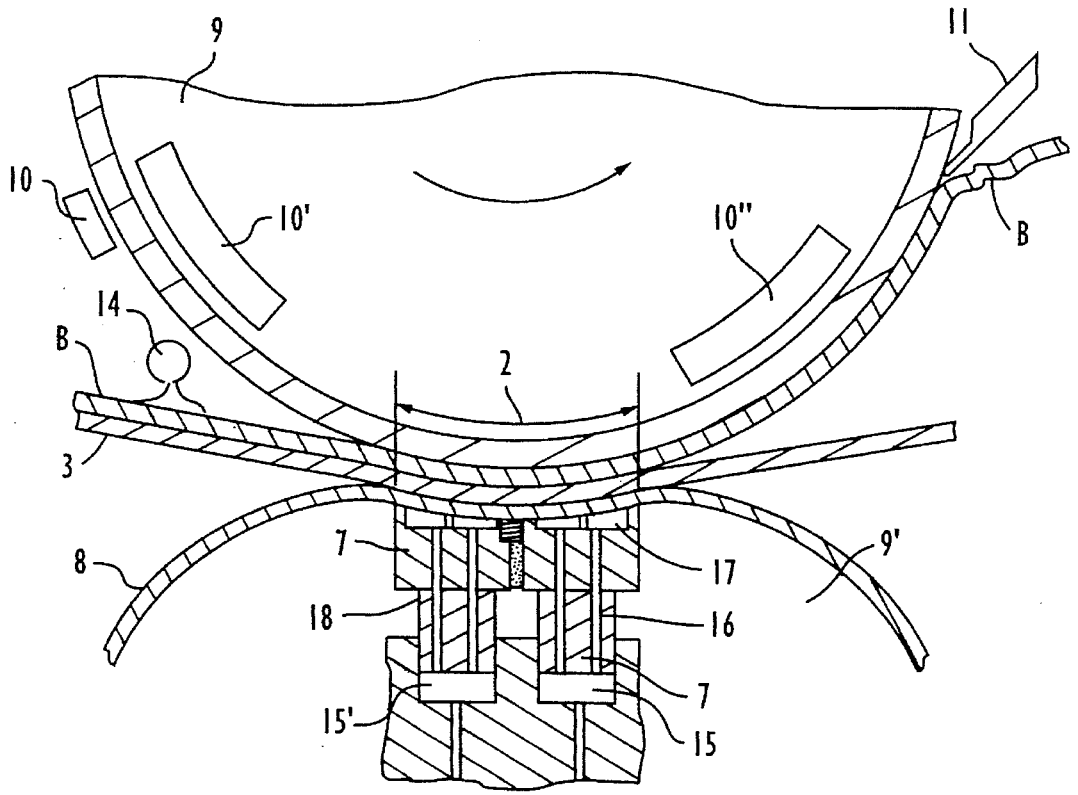
FIG. 7 shows more detail, but is still schematic and in section, a portion of a wide nip press which is suitable for carrying out the process.

FIG. 7 shows, in more detail, the technical relationships in the press gap of a wide nip press suitable for carrying out the process. The press shoe 7, recognizably drawn in section, in this embodiment includes two respective subsequently arranged pressure chambers 15, 15'. Such an expense is not absolutely necessary, but facilitates the desired setting of different pressure steps in press gap 2. The exemplary shown pressure chamber 15 is connected with a pressure pocket 17 via a canal 16, with pressure pocket 17, via flexible covering 8, transferring the press force to web B via hydrostatic means. The press shoe is also covered by elastic covering 8 which, in its form adapts itself to the cylindrical covering of counter roll 9. Felt 3, as well as web B, move through press gap 2. Web B remains on counter roll 9, at the end of press gap 2 while felt 3 is removed. Web B is buckled via crepe scraper 11 and thereafter also removed from counter roll 9.

Scraper 11 crepes the paper web and thus additionally receives the properties desired for the volume effect. A prerequisite is therefore the adhesion of the web at the counter roll after its passage through the press gap. With the spraying on of a layer suitable for the high temperatures, the adhesion for specified production conditions can be assured. If, in place of the layer, means suitable for improving adhesion are directly added to the paper mass or sprayed on the web shortly before its inlet into the press gap, then the temperature stability of the adhesion means is less critical.

Within the roll a heating device 10' is shown ahead of press gap 2 and a heating device 10'' is shown after press gap 2, together with an external heating device 10. It should be understood that not all illustrated heating devices are required simultaneously, which however, in some instances could be of advantage. An additional possibility for introducing heat into the press gap is possible when, for example, an induction apparatus 18 is provided in the region of press shoe 7, which is aimed directly at the metallic covering of counter roll 9 and produces very well regulated heat. A further possibility is feasible in that the pressure medium for the press shoe is heated, whereby however, the heat must be transferred through felt or the like, before it arrives, as desired, at the paper web.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A process for removing water from a paper web in the production of toilet paper, the web having a final dry weight of at least 60%, the process comprising:

guiding a moist paper web and at least one water-absorbing felt through at least one press zone between two press areas;

transferring, in one of before or within the at least one press zone, at least an amount of heat into the paper web so that steam pressure being formed within a fiber structure of the paper web is greater than ambient pressure and less than a pressure existing in the press zone; and adjusting pressure and temperature conditions within the press zone such that, at an end portion of the press zone, the steam pressure within the water is slightly greater than ambient pressure, so that a portion of the water remaining in the paper web controllably evaporates and breaks up the fiber structure of the paper web due to sudden expansion of the paper web upon exiting a press gap of the press zone.

2. The process of claim 1, including, supplying additional heat to the paper web after the paper web leaves the press zone.

3. The process of claim 1, including, forming the press areas as an elongated press zone.

4. The process of claim 1, including, utilizing two successively, when viewed in the direction of movement of the web, arranged press zones.

5. The process of claim 4, including, as a result of the heating of the paper web in the at least one press zone, lifting the paper web, due to steam generation, from a portion of the press area, not in contact with the felt, and thereafter supporting the paper web on the felt.

6. The process of claim 1, including, as a result of steam generation due to heating of the paper web, in a last one of the at least one press zone, lifting the paper web from a portion of the press area, not in contact with the felt, and subsequently removing the paper web.

7. The process of claim 5, including, one of coiling and treating the removed paper web without the paper web undergoing creping.

8. The process of claim 1, including, maintaining a surface temperature of a press area, in a last one of the at least one press zone, at at least 150° C.

9. The process of claim 8, including, maintaining a surface temperature of a press area, in the last press zone, at approximately 300° C.

10. The process of claim 1, including, supplying the web to a first press zone with an initial dry weight of between 10 and 30%.

11. The process of claim 1, including, selecting parameters that the web, after the drying in a last one of the at least one press zone, has a dry weight of more than 80%.

12. The process of claim 1, including maintaining a web temperature, ahead of the last press zone, between 50° and 100° C.

13. The process of claim 12, including, maintaining a web temperature, ahead of the last pressure zone, at at least 80° C.

14. The process of claim 1, including, maintaining a dwelling time of the web in each press zone for at least 15 milliseconds.

15. The process of claim 1, including, maintaining a pressure within the press zone at at least 10 bar.

16. The process of claim 1, including, keeping the web being dewatered at a sheet weight of between 10 and 40 $g/m^2$.

17. The process of claim 1, including, introducing additional heat above a press area.

18. The process of claim 1, including, introducing additional heat ahead of the at least one press zone.

* * * * *